US005688391A

United States Patent [19]

Hayes

[11] Patent Number: 5,688,391

[45] Date of Patent: Nov. 18, 1997

[54] METHOD FOR ELECTRO-DEPOSITION PASSIVATION OF INK CHANNELS IN INK JET PRINTHEAD

[75] Inventor: Donald J. Hayes, Plano, Tex.

[73] Assignee: MicroFab Technologies, Inc., Plano, Tex.

[21] Appl. No.: 621,680

[22] Filed: Mar. 26, 1996

[51] Int. Cl.[6] ..... C25D 13/12; B41J 2/045

[52] U.S. Cl. ..... 204/478; 204/479; 204/484; 204/500; 204/501; 204/510; 205/122; 205/127; 347/71

[58] Field of Search ..... 204/499, 500, 204/501, 510, 471, 478, 479, 484; 205/122, 127; 347/71

[56] References Cited

U.S. PATENT DOCUMENTS

| | | | |
|---|---|---|---|
| 4,019,877 | 4/1977 | Gass et al. | 428/626 |
| 4,159,233 | 6/1979 | Ting et al. | 204/181 C |
| 4,511,598 | 4/1985 | Creagh | 427/58 |
| 4,711,917 | 12/1987 | McCollum et al. | 523/400 |
| 5,098,527 | 3/1992 | Banks et al. | 205/198 |
| 5,208,980 | 5/1993 | Hayes | 29/890.1 |
| 5,227,813 | 7/1993 | Pies et al. | 347/71 |
| 5,235,352 | 8/1993 | Pies et al. | 347/71 |
| 5,334,415 | 8/1994 | Hayes et al. | 427/231 |
| 5,345,256 | 9/1994 | Stortz | 347/20 |
| 5,365,645 | 11/1994 | Walker et al. | 29/25.35 |
| 5,373,314 | 12/1994 | Everett et al. | 347/71 |
| 5,400,064 | 3/1995 | Pies et al. | 347/68 |
| 5,402,162 | 3/1995 | Fusting et al. | 347/43 |
| 5,406,319 | 4/1995 | Hayes et al. | 347/71 |
| 5,414,916 | 5/1995 | Hayes | 29/25.35 |
| 5,426,455 | 6/1995 | Williamson et al. | 347/10 |
| 5,430,470 | 7/1995 | Stortz | 347/54 |
| 5,433,809 | 7/1995 | Pies et al. | 156/268 |
| 5,435,060 | 7/1995 | Hayes et al. | 29/890.1 |
| 5,436,648 | 7/1995 | Stortz et al. | 347/10 |
| 5,444,467 | 8/1995 | Stortz | 347/12 |

*Primary Examiner*—Kathryn L. Gorgos
*Assistant Examiner*—William T. Leader
*Attorney, Agent, or Firm*—Locke Purnell Rain Harrell

[57] ABSTRACT

A method for manufacturing ink jet printheads and the product printheads derived therefrom. The method involves the electrodeposition passivation of ink channels in ink jet printheads.

5 Claims, 2 Drawing Sheets

METHOD FOR ELECTRO-DEPOSITION PASSIVATION OF INK CHANNELS IN INK JET PRINTHEAD

BACKGROUND OF THE INVENTION

1. Field of the Invention

The present invention relates in general to a method for manufacturing ink jet printheads and the product printheads derived therefrom, and, more particularly, to a method for electrodeposition passivation of ink channels in ink jet printheads and printheads with ink channels passivated by such method.

2. Description of the Related Art

Printers provide a means of outputting a permanent record in human readable form. A printing technique may generally be categorized as either impact printing or non-impact printing. A popular form of non-impact printing is referred to as ink jet printing. In ink jet printing, ink is ejected, most commonly by pressure, through a tiny nozzle to form an ink droplet that is deposited upon a paper medium. Such ink jet printing devices produce highly reproducible and controllable droplets, so that a droplet may be printed at a location specified by digitally stored data. Most commercially available ink jet printing systems may be generally classified as either "continuous jet" or "drop-on-demand" ink jet printing systems. In a continuous jet ink jet printing system, ink droplets are continuously ejected from the printhead and either directed to or away from the paper or other substrate depending on the desired image to be produced. In a drop-on-demand ink jet printing system, ink droplets are ejected from the printhead in response to a specific command related to the image to be produced.

Drop-on-demand ink jet printing systems are based upon the production of droplets by electromechanically induced pressure waves. The ink is typically stored in a reservoir or channel. A volumetric change in the ink fluid so stored is then induced by the application of a voltage pulse to an electromechanical material, such as a piezoelectric material, which is directly or indirectly coupled to the fluid. This volumetric change causes pressure/velocity transients to occur in the fluid and these are directed so as to produce a droplet that issues from the reservoir or channel, typically through an orifice. Since the voltage is applied only when a droplet is desired, these types of ink jet printing systems are referred to as drop-on-demand.

The use of piezoelectric materials in ink jet printers is well known. Most commonly, piezoelectric materials are used in a piezoelectric transducer by which electric energy is converted into mechanical energy by applying an electric field across the material, thereby causing the piezoelectric material to deform. This ability to deform piezoelectric material has often been utilized in order to force the ejection of ink from the ink reservoirs, passages or channels of drop-on-demand type systems. Illustrative patents showing the use of piezoelectric materials in ink jet printers include U.S. Pat. Nos. 3,857,049, 4,584,590, 4,825,227, 4,536,097, 4,879,568, 4,887,100, 5,227,813, 5,235,352, 5,334,415, 5,345,256, 5,365,645, 5,373,314, 5,400,064, 5,402,162, 5,406,319, 5,414,916, 5,426,455, 5,430,470, 5,433,809, 5,435,060, 5,436,648 and 5,444,467.

One drop-on-demand type ink jet printer configuration which utilizes the distortion of a piezoelectric material to eject ink includes a printhead forming an ink channel array in which the individual channels of the array each have side walls formed at least, in part, of a piezoelectric material. In the typical case of such an array, the channels are microsized and are arranged such that the spacing between adjacent channels is relatively small. In operation of this type printhead, ink is directed to and resides in the channels until selectively ejected therefrom. Ejection of ink from selected channels is effected due to the electromechanical nature of the piezoelectric side walls of the channels. Because piezoelectric material deforms when an electric field is applied thereacross, the side walls of selective channels may be caused to deform by applying an electric field across select ones thereof. The electric field may be so selectively applied by digital or other means. This deformation of side walls of select channels reduces the volume of the respective channels creating a pressure pulse in the ink residing in those channels. The resultant pressure pulse then causes the ejection of a droplet of ink from the front end of the particular channel adjacent the side walls across which the electric field is applied.

Many ink jet printheads also include a cover plate fixedly mounted on the front end of the printhead adjacent the ink channels. Extending through such a cover plate may be a plurality of orifices which comprise an array. In most ink jet printheads, each orifice in such an orifice array corresponds to one of the ink channels of the printhead. A cover plate is typically positioned abutting the printhead in a manner so that each orifice is in communication with a corresponding channel of the printhead. When a pressure wave is created in ink in a typical ink jet printhead due to electromechanical action or otherwise, an ink droplet is forcibly ejected from the ink jet printhead through the orifice. This type of orifice can form an appropriate ink droplet to create a desired impression as the droplet is thereby deposited on a selected medium.

In a typical configuration, the electrical conductors used to apply the electric field across the piezoelectric material of the channels extend to the edge of and are exposed within the walls of the channels. Accordingly, when conductive fluids, such as water-based inks are disposed within the channels of such ink jet printheads (such as described in U.S. Pat. Nos. 4,879,568, 4,887,100, 5,227,813 and 5,235,352, which are incorporated herein by reference), electrical current flows through the fluid and degradation in performance will occur unless there is complete protection or isolation of the active piezoelectric material or electrical conductors on the piezoelectric material from the conductive fluids. Degradation can consist of bubble formation upon the application of an electric field to actuate the ink carrying channels resulting in printing errors. Degradation can also consist of shorting of the electric field in the piezoelectric material which is in contact with the conductive fluid. Degradation can further consist of chemical attack of the active piezoelectric material by the conductive fluid. The current flow and degradation in performance results in printing errors. There is a need, therefore, for an ink jet printhead in which the electrical conductors disposed within the printhead are isolated from the ink or other fluid disposed within the channels.

SUMMARY OF THE INVENTION

The present invention is directed to a method for creating a passivation coating on the surfaces of channels of a workpiece.

In a preferred embodiment, the method of the present invention is directed to creating a passivation coating on the surfaces of channels in an ink jet printhead so as to isolate the electrical conductors in the printhead from the fluid disposed within the channels.

In one embodiment of the method of the present invention, a passivation coating is created inside the channels of an ink jet printhead by applying a controlled thickness passivation coating over any exposed metal surfaces in the channels by means of an electrodeposition or electrocoating process.

In a preferred embodiment of the present invention, the exposure of the metal surfaces in the channels is minimized by means of electropolishing prior to applying the passivation coating to the exposed metal surfaces. Other embodiments of the present invention may not allow fort he electropolishing process but would still benefit from the electrodeposition process.

BRIEF DESCRIPTION OF THE DRAWINGS

Other advantages and features of the invention will become more apparent with reference to the following detailed description of presently preferred embodiments thereof in connection with the accompanying drawings, wherein like reference numerals have been applied to like elements, in which.

DESCRIPTION OF THE PREFERRED EMBODIMENT

Figure 1:
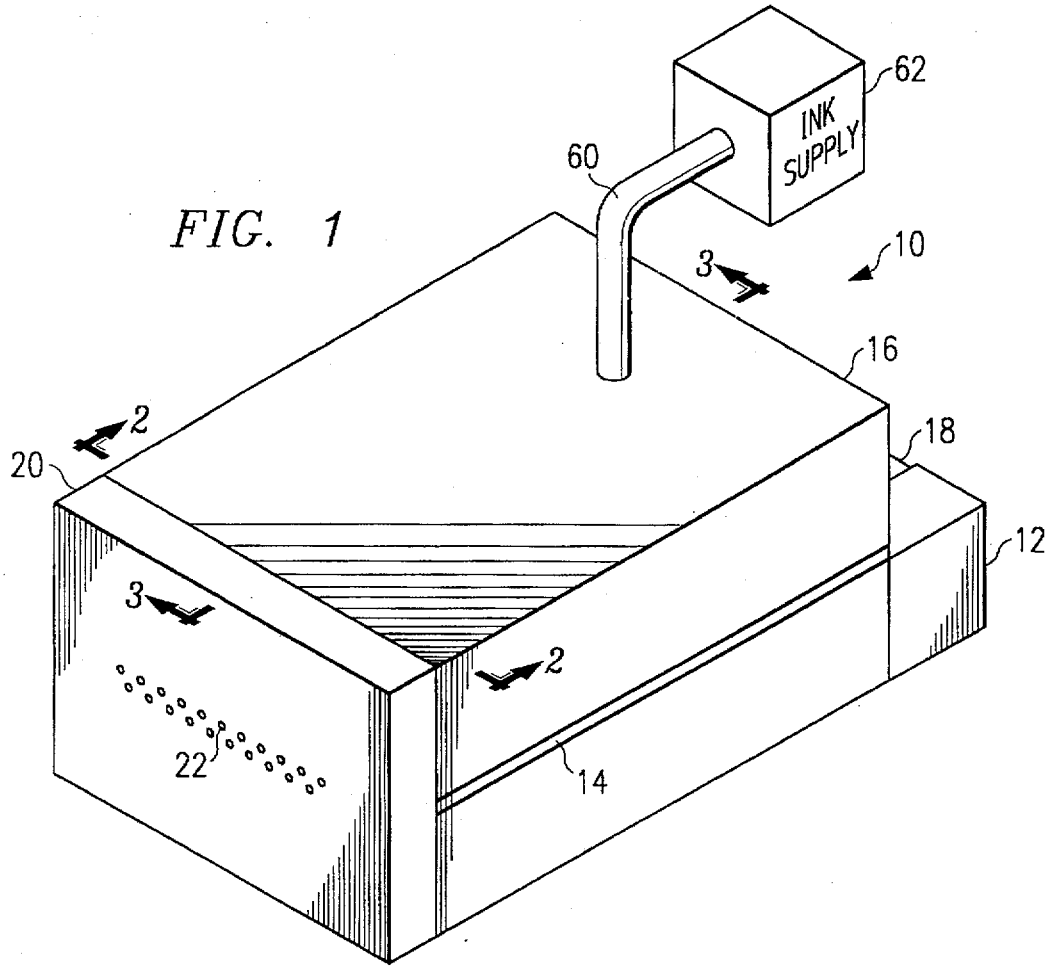
FIG. 1 is a perspective view of a schematically illustrated ink jet printhead to which a passivation coating may be applied according to the method of the present invention.

Electrodeposition is an electrolytic process by which organic materials may be coated from aqueous suspension, or solution, onto a conductive substrate under the influence of electricity. The process is self-regulating and utilizes direct current to deposit organic materials, such as resins, on a conductive substrate. The process also involves the phenomenon of electrophoresis which means the migration of colloidal or suspended particles in an electric field. Depending upon the type of particles to be deposited, the particles will migrate either to the anode which is called anaphoresis or to the cathode which is called cataphoresis. In either case, the process requires ionizable resins that can be diluted with water and deposited from an aqueous medium under the influence of an electric current.

In a cataphoretic deposition process, the part to be coated is made the cathode in the electrical structure. In an anaphoretic deposition process, the part to be coated is made the anode in the electrical structure. In both cases, the small particles to be deposited are called micelles and typically have a size smaller than 200 nm and bear a surface charge. In a cataphoretic deposition process, the micelles are disposed in a cataphoretic solution and the micelles migrate by electrophoresis toward the cathode at a rate in the range of micrometers per second when an electric field is applied at a level greater than 1 volt/mm. Some dissolution of the anode is possible during this process. When the micelles reach the cathode, their positive charges are neutralized by hydroxide ions produced by the electrolysis of water. The micelles then become destabilized, and coalesce on the surface of the cathode to form a self-limiting, insulating film that emerges nearly dry from the coating bath. The small size of the individual micelles results in good packing densities, even coatings and elimination of pinholes. As a result, the process produces a highly uniform and defect-free coating. The self-limiting nature of the electro-deposited coatings is mainly dependent on the voltage of the electric field applied to the cataphoretic bath, the coating time and the temperature of the cataphoretic bath. As the continuous film begins to form, the electric field driving the electrophoresis gradually diminishes since more of the cell voltage drops across the growing film than across the bath emulsion. The film growth continues until its resistance is so high that the electric field across the cataphoretic bath is too low to deliver any more micelles to the cathode. Once the film growth is completed, the film is thermally, photochemically or otherwise set or cured by techniques well known to those of ordinary skill in the art.

In a preferred embodiment of the present invention, the electrodepositable film forming resins that may be utilized in the method include acrylates, epoxies and novolacs. These and other suitable resins are commercially from Shell Chemical Company, DuPont Company and Dow Chemical Company. Those of ordinary skill in the art will recognize that for a resin to be electrodepositable, the resin must contain a distribution of ionizable groups along its molecular chain. Those of ordinary skill in the art will also recognize that particularly preferred electrodepositable resins include those that have superior coating performance, uniformity on complex surfaces, freedom from pinholes and allow control of coating thicknesses.

Electropolishing is a process by which the surface of metal part is smoothed and enhanced by making it an anode in a suitable electrolyte. Electropolishing is the reverse of electrodeposition and is a process in which metal is removed from the surface of a metal part. Typically, an acid solution is used as the electrolyte. A bias voltage is applied which causes metal ions to leave the surface of the part to be electropolished. The released metal ions travel through the electrolyte solution to the cathode.

Referring now to the drawings wherein thicknesses and other dimensions have been exaggerated in the various figures as deemed necessary for explanatory purposes and wherein like reference numbers designate the same or similar elements throughout the several views, an ink jet printhead 10 according to the present invention is shown in FIG. 1. The ink jet printhead 10 may be used in connection with the devices disclosed and claimed in U.S. Pat. Nos. 5,227,813, 5,235,352, 5,334,415, 5,345,256, 5,365,645, 5,373,314, 5,400,064, 5,402,162, 5,406,319, 5,414,916, 5,426,455, 5,430,470, 5,433,809, 5,435,060, 5,436,648 and 5,444,467, the entire disclosures of which are hereby incorporated herein by reference. As shown in FIG. 1, the ink jet printhead 10 includes a main body portion 12 which is aligned, mated and bonded to an intermediate body portion 14 which, in turn, is aligned, mated and bonded to a top body portion 16.

A plurality of vertical grooves of predetermined width and depth are formed through the intermediate body portion 14 and the main body portion 12 to form a plurality of pressure chambers or channels 18 (not visible in FIG. 1), thereby providing a channel array for the ink jet printhead 10. In conventional manner, the channels 18 are in fluid communication with external fluid conduit 60 and ink supply 62.

The ink jet printhead 10 further includes a front wall 20 having a plurality of orifices 22 extending therethrough.

Each orifice 22 is in fluid communication with a corresponding one of said plurality of channels 18, thereby providing fluid ejection nozzles for the ink jet printhead 10.

Figure 2:
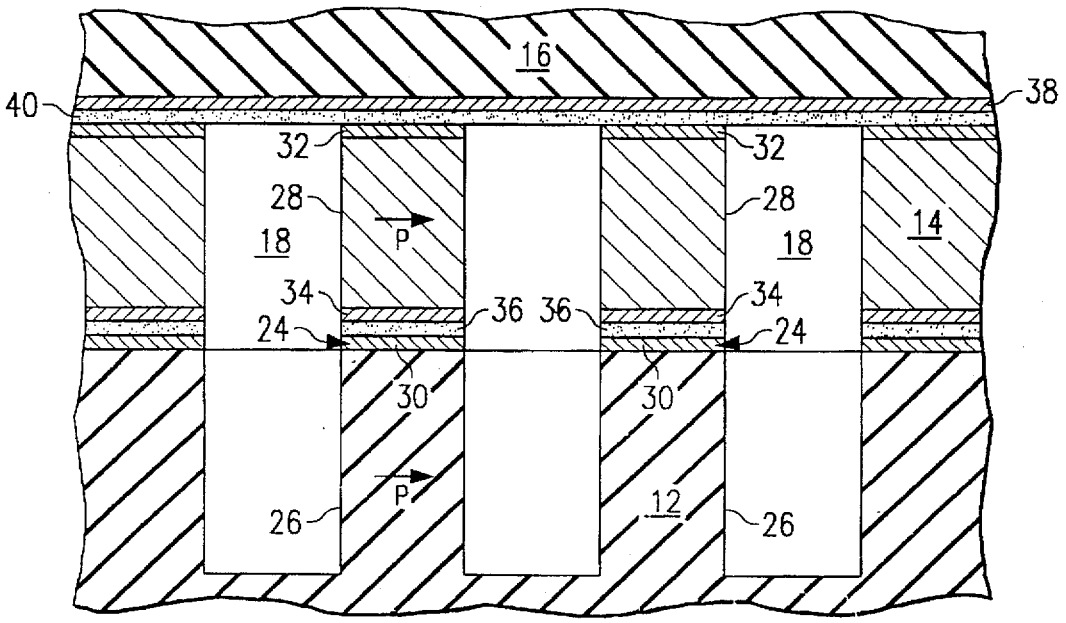
FIG. 2 is an enlarged partial cross-sectional view of the ink jet printhead of FIG. 1 taken along line 2—2 and illustrating a parallel channel array of the ink jet printhead of FIG. 1.

FIG. 2 shows an enlarged partial cross-sectional view of the ink jet printhead 10 taken along line 2—2 of FIG. 1. The ink jet printhead 10 includes a plurality of parallel spaced channels 18, each channel 18 vertically extending from the top body portion 16, along the intermediate body portion 14 and part of the main body portion 12 and extending lengthwise through the ink jet printhead 10. The main body portion 12 may be constructed of inactive or active material such as unpolarized or poled piezoelectric material and the top body portion 16 may be constructed of an inactive material such as unpolarized piezoelectric material. Separating adjacent channels 18 are sidewall actuators 24, each of which include a first sidewall section 26 and a second sidewall section 28. The first sidewall section 26 may be constructed of an inactive or active material, for example unpolarized or poled piezoelectric material, and, in a preferred embodiment of the present invention, is integrally formed with the body portion 12. When the first sidewall section 26 is constructed of an active poled piezoelectric material, it may be formed of lead zirconate titanate (PZT), polarized in direction "P" perpendicular to the channels 18. The second sidewall section 28, is formed of an active material, for example, poled piezoelectric material such as lead zirconate titanate (PZT), polarized in direction "P" perpendicular to the channels 18.

Mounted to the top side of each first sidewall section 26 is a metallized conductive surface 30, for example a strip of metal. Similarly, metallized conductive surfaces 32 and 34, also formed of a strip of metal, are mounted to the top and bottom sides, respectively, of each second sidewall section 28. A first layer of a conductive adhesive 36, for example, an epoxy material, is provided to conductively attach the metallized conductive surface 30 mounted to the first sidewall section 26 and the metallized conductive surface 34 mounted to the second sidewall section 28. Finally, the bottom side of the top body portion 16 is provided with a metallized conductive surface 38 which, in turn, is conductively mounted to the metallized conductive surface 32 of the second sidewall section 28 by a second layer of a conductive adhesive 40. In this manner, a series of channels 18, each channel being defined by the piezoelectric material of the main body portion 12 along its bottom, the layer of conductive adhesive 40 along its top and a pair of sidewall actuators 24 is provided. Each sidewall actuator 24 is shared between adjacent channels 18.

Prior to assembling an electronic controller, the front cover 20, the external conduit 60 and the ink supply 62 to the printhead 10, a passivation coating may be applied to all exposed metallized conductive surfaces that come into contact with the conductive fluid or ink disposed in the channels 18 according to the present invention.

Figure 3:
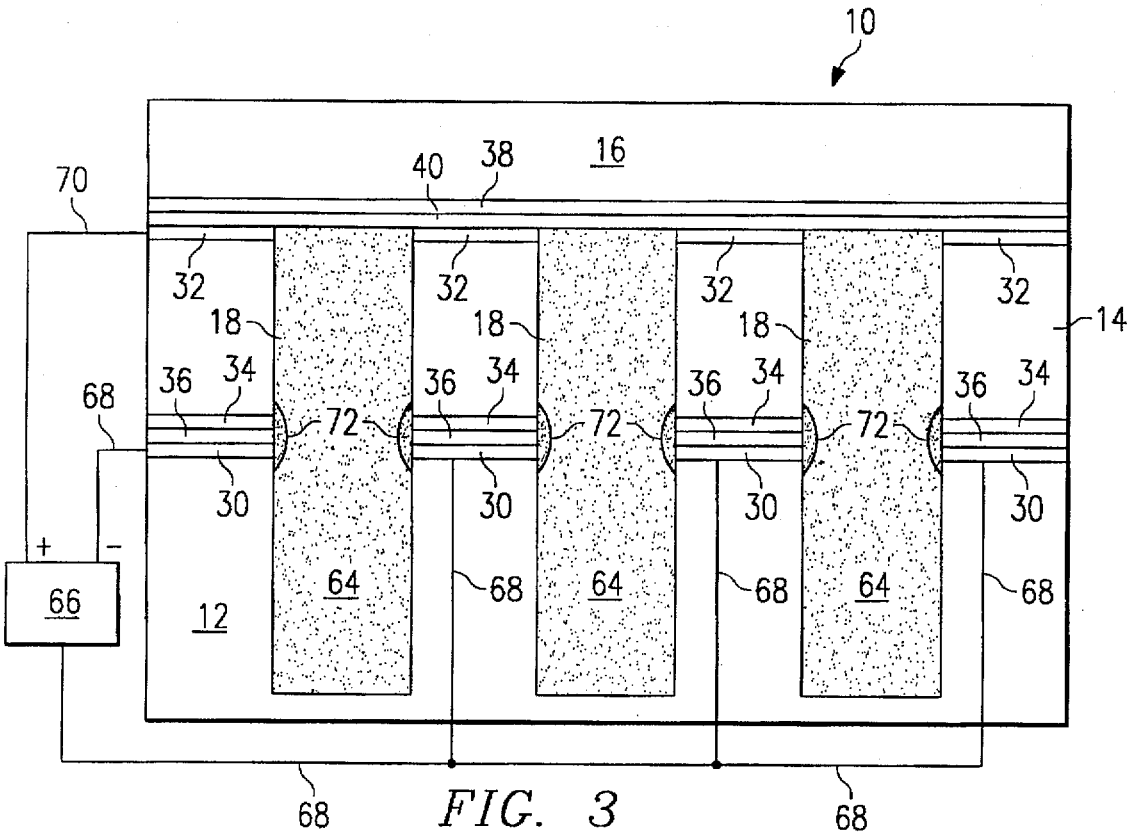
FIG. 3 is a schematic view of an ink jet printhead connected to a voltage supply to carry out the method of the present invention.
Figure 4:
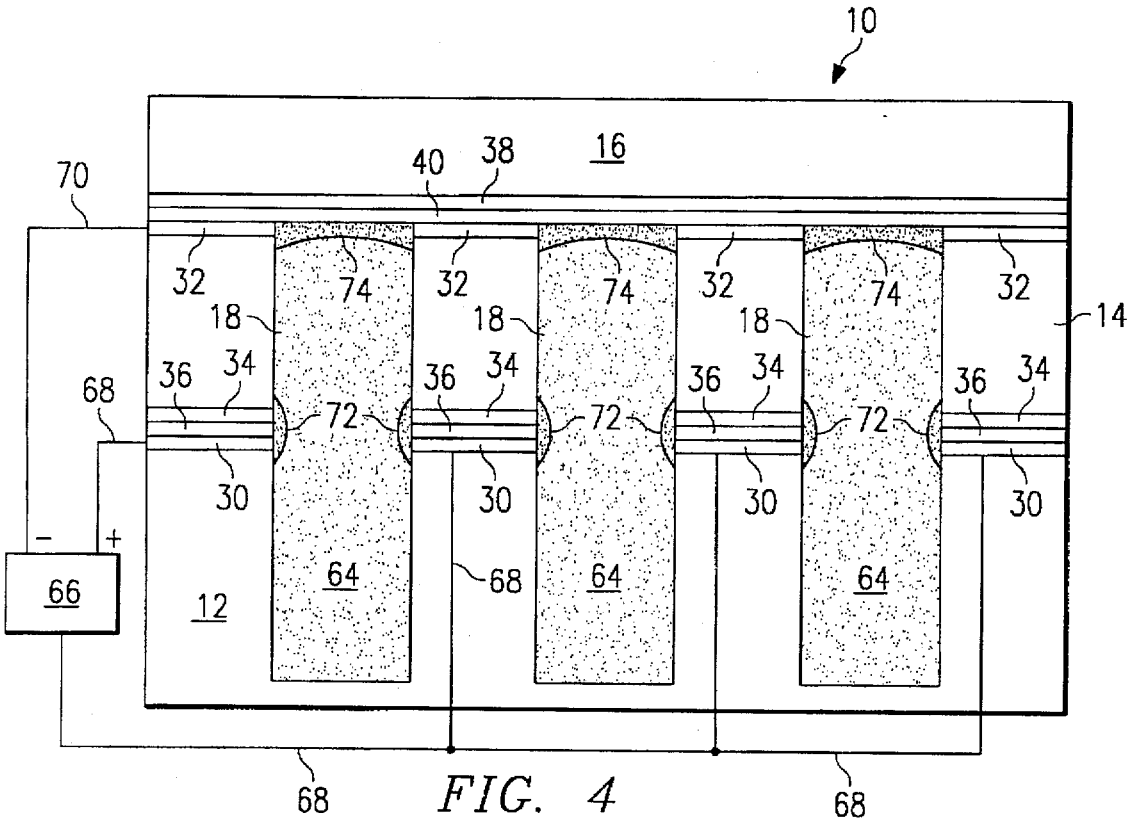
FIG. 4 is a schematic view of an ink jet printhead connected to a voltage supply to carry out the method of the present invention.

As shown schematically in FIG. 3, the printhead 10 is placed in a polymer deposition solution so that the polymer deposition solution 64 fills the channels 18. A voltage supply 66 is connected to the printhead 10. According to one embodiment of the present invention, the lead 68 of the voltage supply 66 is a negative lead and is connected to the exposed surfaces of the metallized conductive surfaces 30 which are electrically connected to conductive surfaces 34 through the layer of conductive epoxy 36. The metallized conductive surfaces 30 and 34 and the conductive epoxy 36 thus become the cathode. The lead 70 of the voltage supply 66 is positive relative to lead 68 and is either connected to ground or connected to the exposed surface of the metallized conductive surface 32 which is electrically connected to metallized conductive surface 38 through the layer of conductive epoxy 40, making the metallized conductive surfaces 32 and 38 and the layer of conductive epoxy 40 into the anode. Upon energizing the voltage supply 66, micelles in the polymer deposition solution 64 migrate to the cathodes and are deposited on the conductive surfaces 30, 34 and 36 to form passivation coatings 72. The process continues until all exposed surfaces of the conductive surfaces 30, 34 and 36 are covered by the passivation coatings 72. Once the exposed surfaces of the conductive surfaces 30, 34 and 36 are covered and all pinholes in the passivation coatings are filled, the electric current in the channels is reduced and the process slows down.

After the passivation coating 72 is applied, the printhead 10 is removed from the polymer deposition solution 64 and the passivation coatings 72 are thermally or photochemically cured.

After the passivation coatings 72 are cured, the printhead 10 can be returned to the polymer deposition solution 64 and the polarity of the voltage supply 66 may be reversed making the conductive surfaces 32, 38 and 40 into the cathode. Upon energizing the voltage supply 66, micelles in the polymer deposition solution 64 migrate to the cathode to form passivation coatings 74. The electric field generated upon the reversal of the polarity of the voltage supply 66 is weaker than the original electric field so that the passivation coating 74 is deposited on the conductive surfaces 32, 38 and 40 at a slower rate.

After the passivation coatings 74 are applied, the printhead 10 is removed from the polymer deposition solution 64 and the passivation coatings 74 are thermally or photochemically cured.

Those of ordinary skill in the art will recognize that all conductive surfaces in the printhead 10 can be made into the cathode and coated simultaneously. In this instance, the voltage supply would be grounded externally.

Those of ordinary skill in the art will recognize that the passivation coatings 72 can be applied to the conductive surfaces 30, 34 and 36 prior to the attachment of the top body portion 16.

While the present invention has been described in terms of a cataphoretic process in which the metallized or other conductive surface to be coated was made the cathode, those of ordinary skill in the art will recognize that the passivation coatings 72 and 74 can be generated through an anaphoretic deposition process in which the metal to be coated is made the anode. Those of ordinary skill in the art will also recognize that the polymer deposition solution 64 that fills the channels 18 can be formulated to include both anodic and cathodic micelles. In this manner, when the voltage supply 66 is energized, a passivation coating will simultaneously be deposited on all conductive surfaces in the printhead.

In a preferred embodiment of the present invention, the metallized surfaces in the ink jet printhead 10 are electropolished prior to the deposition of the passivation coatings 72 and 74. According to the electropolishing step, the ink jet printhead 10 is placed in an acid bath and a voltage supply is attached to the printhead in a manner to make the exposed metallized surfaces into the anode. When the voltage supply is energized, a slight amount of the metal of the metallized surfaces, such as surfaces 30 and 34 will be removed or etched at the fluid interface which will not degrade the performance of the printhead 10. This will minimize the amount of exposed metal to be coated by the passivation coatings. Certain embodiments of the present invention may not allow for the electropolishing process but would still benefit from the electrodeposition process.

While the present invention has been described with reference to a presently preferred embodiment, it will be appreciated by those of ordinary skill in the art that various modifications, changes, alternatives and variations may be made therein without departing from the spirit and scope thereof as defined in the appended claims.

What is claimed is:

1. A method for coating exposed conductive surfaces of a workpiece, comprising the steps of:

placing in a solution of an electrodepositable polymer resin a workpiece comprising an ink jet printhead, said ink jet printhead comprising:

a base section formed from a piezoelectric material, said base section having a plurality of generally parallel spaced projections extending longitudinally along said base section, each of said projections having a top side;

first conductive surfaces mounted on said top side of each said base section projection;

a plurality of intermediate sections mounted on said first conductive surfaces, each intermediate section having a top side and a bottom side and being formed from a piezoelectric material;

second conductive surfaces mounted on said top side of each said intermediate section; and a top section mounted on said second conductive surfaces, wherein portions of said first conductive surfaces between said base section projections and said intermediate sections, and of said second conductive surfaces between said intermediate sections and said top section remain exposed thereby forming exposed conductive surfaces;

attaching said workpiece to a voltage supply wherein said exposed conductive surfaces are made into electrodes;

energizing said voltage supply thereby causing said electrodepositable polymer resin in said solution to migrate to at least some of said electrodes to form a coating.

2. A method according to claim 1, further comprising the step of:

curing said coating by means selected from the group consisting of thermal energy and photochemical radiation.

3. A method according to claim 1, wherein prior to coating said exposed conductive surfaces with an electrodepositable polymer resin, said method further comprising the steps of:

placing the workpiece in an acidic solution;

attaching the workpiece to a voltage supply wherein said exposed conductive surfaces are made into anodes;

energizing said voltage supply whereby said exposed conductive surfaces are etched by said acidic solution.

4. A method according to claim 1, wherein said voltage supply is connected to said first conductive surfaces making said first conductive surfaces into cathodes.

5. A method according to claim 4, wherein said voltage supply is connected to said second conductive surfaces making said second conductive surfaces into anodes.

* * * * *